US006823678B1

(12) United States Patent
Li

(10) Patent No.: US 6,823,678 B1
(45) Date of Patent: Nov. 30, 2004

(54) AIR CONDITIONER SYSTEM FOR FLEXIBLE MATERIAL-BASED DEVICES

(75) Inventor: Zhixin Li, Hudson, NH (US)

(73) Assignee: Ferrotec (USA) Corporation, Nashua, NH (US)

( * ) Notice: Subject to any disclaimer, the term of this patent is extended or adjusted under 35 U.S.C. 154(b) by 0 days.

(21) Appl. No.: 10/743,640

(22) Filed: Dec. 22, 2003

(51) Int. Cl.[7] ..... F25B 21/02
(52) U.S. Cl. ..... 62/3.5; 62/3.2; 62/259.3
(58) Field of Search ..... 62/3.2, 3.3, 3.5, 62/3.7, 259.3

(56) References Cited

U.S. PATENT DOCUMENTS

| | | | | |
|---|---|---|---|---|
| 3,085,405 A | | 4/1963 | Frantti | |
| 4,065,936 A | * | 1/1978 | Fenton et al. | 62/3.3 |
| 4,470,263 A | | 9/1984 | Lehovec et al. | |
| 5,092,129 A | * | 3/1992 | Bayes et al. | 62/3.3 |
| 5,193,347 A | | 3/1993 | Apisdorf | |
| 5,197,294 A | | 3/1993 | Galvan et al. | |
| 5,562,604 A | * | 10/1996 | Yablon et al. | 601/148 |
| 5,800,490 A | | 9/1998 | Patz et al. | |
| RE36,242 E | | 6/1999 | Apisdorf | |
| 6,393,842 B2 | | 5/2002 | Kim et al. | |
| 2003/0097845 A1 | * | 5/2003 | Saunders et al. | 62/3.3 |

* cited by examiner

*Primary Examiner*—Melvin Jones
(74) *Attorney, Agent, or Firm*—Robert R. Deleault, Esq.; Mesmer & Deleault, PLLC

(57) ABSTRACT

An air conditioner system to provide cooling or heating to a flexible material-based device includes a ventilated portion located within a flexible material body, a thermoelectric module with heat exchanges on opposite sides, an air stream source, and a power source. The ventilated portion has two chambers formed between a flexible material inner layer, an intermediate layer and a flexible material outer layer with a plurality of air vents in each of the flexible material inner and outer layers. Each of the heat exchangers is in fluid communication with one of the chambers. The air stream source provides an air flow through the heat exchangers into the chambers and out through the plurality of vent holes. The power source provides power to at least the thermoelectric module.

13 Claims, 6 Drawing Sheets

AIR CONDITIONER SYSTEM FOR FLEXIBLE MATERIAL-BASED DEVICES

BACKGROUND OF THE INVENTION

1. Field of the Invention

The present invention relates generally to an apparatus for air conditioning. Particularly, the present invention relates to a personal air conditioner. More particularly, the present invention relates to an air conditioner system for flexible material-based devices. Even more particularly, the present invention relates to a wearable air conditioner capable of providing cool and warm air to an individual.

2. Description of the Prior Art

It has long been understood that an individual's efficiency is related to the temperature of the individual's body. In hot climates, creating a cooler environment for an individual increases the stamina of that individual because the body does not need to use its internal energy resources to cool the individual. In cold climates, creating a warmer environment for an individual also increases an individual's productivity because the energy generally required by the body to produce heat is available for other uses.

Many different devices have been developed to create the preferred environmental conditions for humans. Earlier developed devices include mechanical heating, air conditioning and specialized clothing. Mechanical heating and air conditioning suffer from several drawbacks. For instance, the devices are generally bulky and stationary devices for heating/cooling a room space. They are not designed to satisfy all individual tastes of persons in the room. The specialized clothing includes garments with circulating cooling liquid.

More recent devices have included the use of thermoelectric elements as the heating/cooling engine. These include uses for environmental suits to condition and filter the air being supplied to the person within the environmental suit. There has even been developed a portable air conditioner that uses thermoelectric modules to provide cooling air to a user. Some of these more recent devices are disclosed.

U.S. Pat. No. 3,085,405 (1963, Franti) discloses a thermoelectric air conditioning apparatus for a protective garment. The garment uses a thermoelectric heat-pumping device that is attached to the back of a protective garment for conditioning and circulating air through the interior of the garment to maintain the wearer in a comfortable range regardless of wide variations in temperature of the ambient atmosphere. The portable device includes a thermoelectric heat pumping panel of generally planar form disposed within a housing structure that joins and defines airflow passages of annular shape. The walls of the housing structure are provided with apertures providing air inlets for the passageways. A first and second blower wheel are centrally disposed in the firs and second passageways and are jointly driven by a suitably mounted motor having a drive shaft extending perpendicularly through the thermoelectric panel. There is an outlet for the first airflow passageway in direct communication with the atmosphere and an outlet for the second passageway in communication with a suitable annular manifold attached to a protective garment.

U.S. Pat. No. 4,470,263 (1984, Lehovec) discloses a Peltier cooled garment. Peltier cells are attached to a garment with the cold plate of the Peltier cell in intimate thermal contact with the skin of the wearer of the garment. Heat generated by the Peltier cell is dissipated to the ambient cooling fins. Heat pipes are used to conduct the heat to the fins, or to distribute the cooling across the skin.

U.S. Pat. No. 5,193,347 (1993, Apisdorf) which was later reissued as U.S. Pat. No. Re. 36,242 (1999, Apisdorf) discloses a helmet mounted air system for personal comfort. The system includes a single lightweight thermoelectric module, mounted in a housing in turn mounted centrally atop a helmet to be worn by a worker in a hot atmosphere. The heat abstraction side of the thermoelectric module is disposed within the housing, the heat dissipation side dissipates heat to the ambient atmosphere. There is a miniature fan means to blow air through the housing and only across the user's face. Two thermistors sense the temperature of air upstream and downstream, respectively, of the heat abstraction side of the thermoelectric module. There is a manual selection means to allow the user to set the temperature difference of air to be delivered to the face.

U.S. Pat. No. 5,197,294 (1993, Galvan) discloses a miniaturized thermoelectric apparatus for air conditioning a protective body suit. The apparatus comprises an assembly made up of a Peltier effect thermoelectric device, in the form of bimetallic or plurimetallic plates connected to a low voltage D.C. power supply. The opposed cold and hot surface of the thermoelectric device are in contact with respective heat exchangers. The assembly is contained in a housing in which two distinct and separate conduits are provided for the forced flow of air through the respective conduits of the heat exchangers.

U.S. Pat. No. 5,800,490 (1998, Patz) discloses a lightweight portable cooling or heating device with multiple applications. The modular device with an injury pack holder provides cooling and/or heating therapy to an injury, having a generally tubular shape and open first end and an open second end. A plurality of module openings are cut through the injury pack holder and covered with a retention mesh. A thermoelectric assembly containing a Peltier device, fan, radiator, first plate and second plate is installed in one of the module openings. The thermoelectric assembly transfers heat energy to a gel pack which cools or heats an area. A battery pack can be installed in another module opening or can be remotely located for operation of the thermoelectric assembly. The injury pack holder has a plurality of attachment straps for affixing the injury pack to various human and animal body parts.

U.S. Pat. No. 6,393,842 (2002, Kim) discloses an air conditioner for individual cooling/heating. The air conditioner includes a front compartment and a rear compartment separated by a partition plate made of an insulating material for forced inlet and outlet of external air therethrough, respectively. The air conditioner also includes at least two heat exchanger parts each in the upper and lower parts of front and rear compartments for making heat exchange with external air passing through the front compartment and the rear compartment, respectively. There are first drawing means and second drawing means mounted in an upper portion or a lower portion of the front compartment or the rear compartment respectively for forced circulation of the external air through the respective compartments, and driving means for driving the first and second drawing means. Each of the heat exchanger parts includes thermoelectric modules connected to a power source for absorbing heat at a heat absorptive part and discharging the heat from a dissipative part provided opposite to the heat absorptive part and heat exchangers in contact either with the heat absorptive part or the heat dissipative part of the thermoelectric module for causing heat exchange between the air flowing into the front or rear compartment and the thermoelectric module, thereby providing individual cooling/heating to a user, and constant temperature dehumidification.

Each of the devices of the prior art have various disadvantages. One disadvantage is they are limited to specialized applications such as a commercial setting requiring a protective body suit that would not be useful to other commercial or recreational applications in which a protective body suit is not wanted or needed. Another disadvantage is that the protective body suit restricts the movement of the user. A further disadvantage of some of the other prior art is that it only provides heating/cooling to certain areas of the body such as the head or neck. Yet, another disadvantage of certain prior art is that while portable it is not wearable.

Therefore, what is needed is a wearable air conditioner using thermoelectric technology that is able to provide cool and warm air to an individual wherever the individual goes. What is further needed is a wearable air conditioner using thermoelectric technology that can provide heating/cooling to a larger area of the body without the use of a full protective body suit. What is still further needed is a wearable air conditioner using thermoelectric technology that is incorporated into bulletproof apparel/body armor.

SUMMARY OF THE INVENTION

It is an object of the present invention to provide a wearable air conditioner using thermoelectric technology that is not used with a protective body suit. It is another object of the present invention to provide a wearable air conditioner using thermoelectric technology that minimizes any restriction to the movement of the user. It is yet another object of the present invention to provide a wearable air conditioner using thermoelectric technology that can provide heating/cooling to a large area of the body by being incorporated into standard apparel such as shirts, pants, jackets, dresses, skirts, footwear, headwear, gloves, shorts, under garments, etc. It is a further object of the present invention to provide a wearable air conditioner using thermoelectric technology that can be incorporated into bulletproof apparel/body armor.

The present invention achieves these and other objectives by providing one embodiment of a wearable air conditioner that includes at least one thermoelectric module, at least one fan blower to generate air flow, at least one heat sink to facilitate heat exchange, ducts and vents to distribute air, a portable power source such as batteries, solar power, fuel cells, or other outside power source to power the thermoelectric module and the fan blower, and a housing system to integrate the above components with apparel. A second embodiment is contemplated where a self-contained housing is used to allow the system to be easily carried.

Thermoelectric modules, which are solid state devices that generally include two dissimilar materials such as N-type and P-type thermoelectric semiconductor elements, work on the Peltier effect. The semiconductor elements are connected to each other through a serial electrical connection. When electric power passes through the thermoelectric module's electrical connections between the two dissimilar semiconductors, the current induces heating or cooling at the junctions. Thus, heat will be transferred from one side of the thermoelectric module to the other side, generating a cold surface with a temperature $T_c$, and a hot surface with a temperature $T_h$. In the present invention, heat sinks are attached to both the cold side and the hot side. The fan blower or blowers are used to generate two separate air streams, one passing through the cold side heat sink and becoming cooler than the ambient temperature, and the other air stream passing through the hot side heat sink and becoming hotter than the ambient temperature.

In the cooling mode, the cold air stream is used to cool the user, and the hot air is dumped into the environment. In the warming mode, the hot air stream is used to provide warmth to the user and the cold air stream is dumped into the environment.

The wearable air conditioner can be incorporated into specially designed clothing such as a jacket, footwear, headwear, gloves, etc., that can be worn by the user, providing cooling or heating wherever the user goes. The air conditioner can also be adapted to be carried by the user in various ways such as, for example, with shoulder straps where the cool or hot air can be distributed to the user's body with hoses, ducts, vents, vented attachments, etc., and simultaneously be used to cool or heat food, beverages or other people. In addition, the air conditioner system of the present invention may also be incorporated into a sleeping bag to provide a source of heat to the occupant. This is very beneficial after sleeping for several hours during which time the body's circulation slows down. The slow down in blood circulation produces less heat output by the body. Because conventional sleeping bags work on the principal of retaining body heat within the sleeping bag to keep the occupant warm, the decrease in body heat generation causes come users to feel cold or at least uncomfortable in that they are not as warm as they would like to be. The present invention may be incorporated to provide a separate source for heating the inside of the sleeping bag, thus keeping the user warm throughout the night.

Alternatively, the air conditioner system may also provide cooling when it is too warm for a comfortable night's sleep. The sleeping bag will also insulate the user from the warmer outside temperature. A temperature control sensor may also be incorporated to prevent overheating or cooling during use. In fact, any device made of flexible material such as, for example, tents and similar enclosures may benefit from the incorporation of the present invention's air conditioner system.

The system is preferably powered by high energy density, rechargeable batteries similar to those used in notebook computers or fuel cells. Several batteries may be placed into the pockets of a specially designed jacket, allowing extended usage and easy replacement. The system can also be powered by an alternative power source such as a 12V vehicle power plug whenever such a source is available. The batteries may be rechargeable by AC or DC means and by solar power, all as is well known by those skilled in the art.

The present invention provides many advantages not provided by the prior art. The wearable air conditioner is useful to individuals who have to work in a hot or cold environment. For example, soldiers in the hot desert who have to wear combat uniforms, motorcyclists, mountain climbers, etc. The present system is more compact and provides easier movement for the wearer. In addition, the present invention can be designed to perform multiple functions. For example, the air conditioned jacket with multiple battery packs may also be used as a bullet proof jacket.

DETAILED DESCRIPTION OF THE PREFERRED EMBODIMENT

Figure 1:
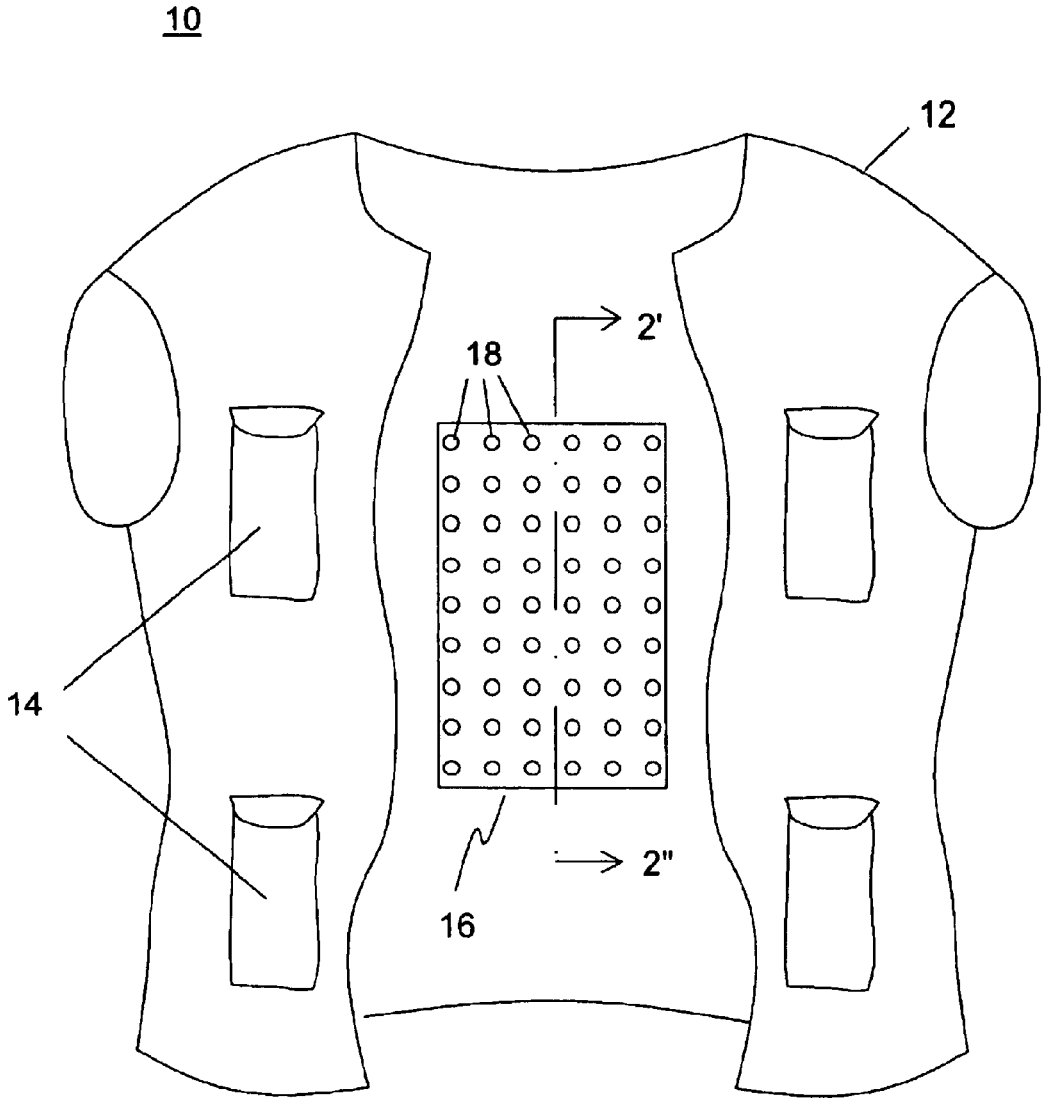
FIG. 1 is a frontal view of one embodiment of the present invention in the form of a jacket.

The preferred embodiment(s) of the present invention are illustrated in FIGS. 1–6. FIG. 1 shows a frontal view of the wearable air conditioner 10 of the present invention in the form of a jacket. The wearable air conditioner 10 includes an outer garment 12 having a plurality of pocket-like areas 14 and a ventilated portion 16 containing a plurality of vent openings 18. Vent openings 18 do not vent to the exterior of the garment 12 but incorporates a two-walled portion at line 2'–2" that is more clearly illustrated by in FIG. 2.

Figure 2:
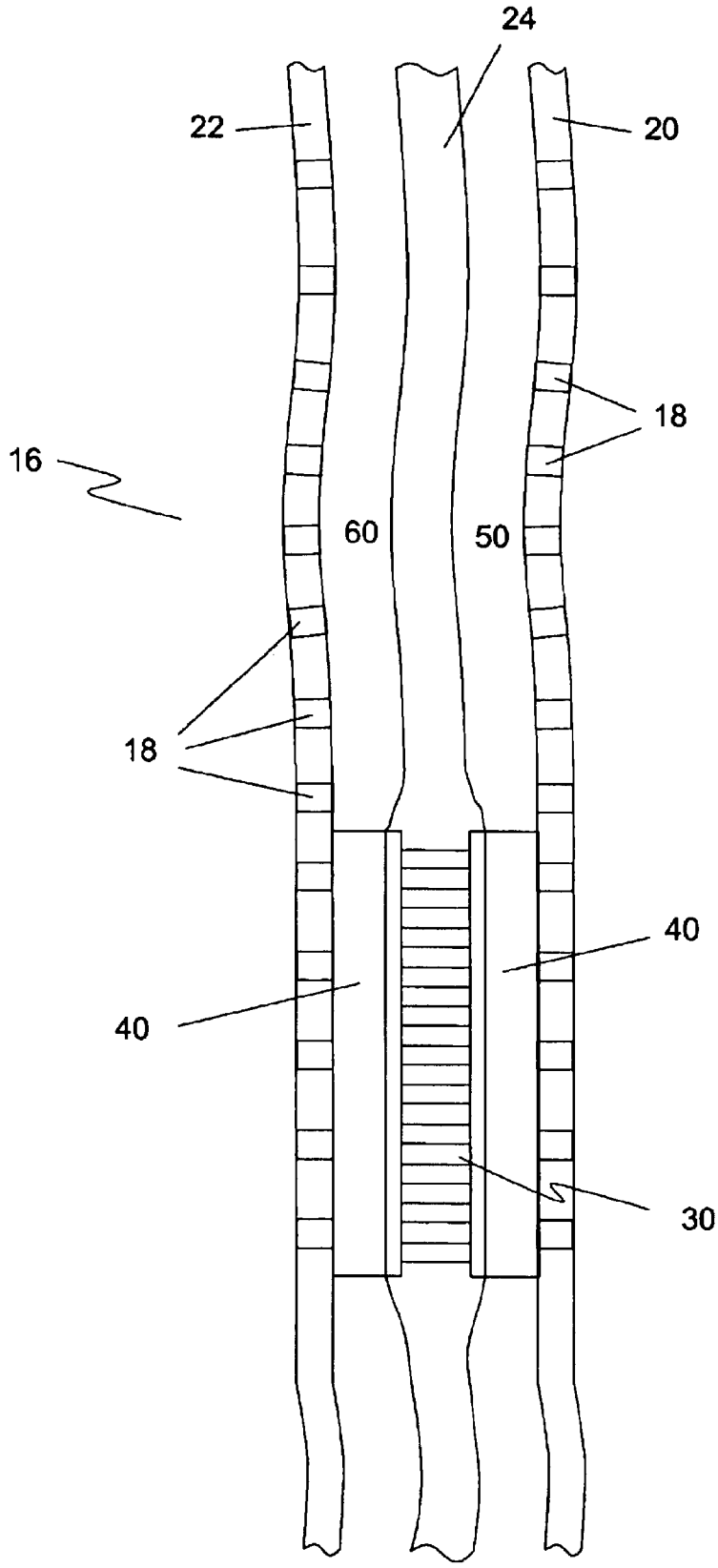
FIG. 2 is an enlarged, cross-sectional view of the present invention showing the embodiment of FIG. 1 taken along line 2'–2".

Turning now to FIG. 2, there is illustrated a portion of the cross-section along line 2'–2" of FIG. 1. Ventilated portion 16 comprises a layered structure having a garment outer layer 20, a garment inner layer 22 and an intermediate wall 24 between outer layer 20 and inner layer 22 forming a first chamber 50 and a second chamber 60. Outer layer 20 and inner layer 22 contain a plurality of vent openings 18. Intermediate wall 24 is typically made of a continuous material to isolate an air flow within one chamber from an air flow in the other chamber. At least one thermoelectric module 30 is situated within or adjacent ventilated portion 16 such that an air flow passing through the heat exchangers 40 is directed into the respective chambers 50 and 60 and out through vent openings 18.

Thermoelectric module 30 is comprised of a plurality of P-type and N-type thermoelectric elements electrically connected in series between a pair of thermally conductive substrates. Application of a current through thermoelectric module 30 will generate a cold surface with a temperature $T_c$, and a hot surface with a temperature $T_h$, all as is well known by those of ordinary skill in the art.

Heat exchangers 40 are in thermal contact with the substrates and are positioned to receive an air flow therethrough. Depending on the direction of the current through thermoelectric module 30, chamber 50 will receive either a heated air flow stream or a cooled air flow stream while chamber 60 will receive the conditioned air flow stream not received by chamber 50. The air flow is provided by one or more fans (not shown) whose air flow output is in fluid communication with the heat exchangers 40. The fans may be place anywhere on garment 12 but will require an extended pathway to guide the air flow stream to heat exchangers 40.

Figure 3:
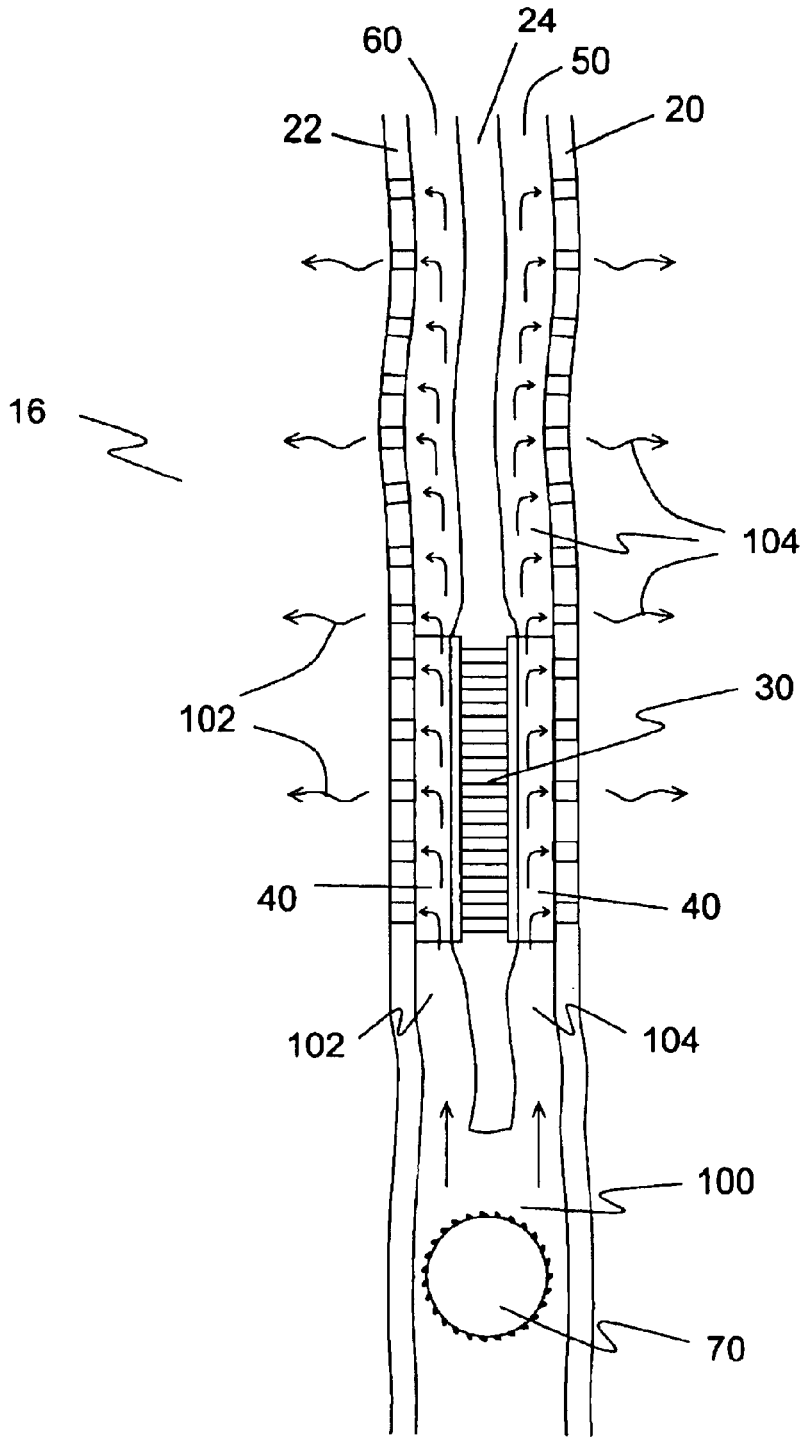
FIG. 3 is an enlarged cross-sectional view of the present invention showing the incorporation of a tube fan below the thermoelectric module

Turning now to FIG. 3, there is illustrated a segment of ventilated portion 16 showing another embodiment incorporating a fan. Proximate to or within the ventilated portion 16, there is at least one thermoelectric module 30 and a pair of heat exchangers 40. Each one of the pair of heat exchangers 40 is in communication with a respective air chamber 50 or 60. The plurality of vent openings 18 in garment outer and garment inner layers 20, 22 distribute one air flow towards the wearer of garment 12 and the other air flow away from the wearer to the ambient air. At least one fan blower 70 is used to generate the air flow, which blower can be located anywhere on or incorporated into garment 12. In this particular example, a miniature, tubular fan assembly is situated within a predefined volume adjacent ventilated portion 16 such that the air flow 100 is divided into two air streams 102 and 104.

In cooling mode, for example, inner layer 22 with vent openings 18 is adjacent to the wearer's body. An air flow stream 102 passes through heat exchanger 40 on the cool side of thermoelectric module 30 becoming cooler than the ambient air temperature, thus delivering a cool air stream directed to the wearer's body. Simultaneously, air flow stream 104 passes through heat exchanger 40 on the hot side of thermoelectric module 30 becoming hotter than the ambient air temperature, thus delivering a hot air stream to the atmosphere and dissipating the heat generated by thermoelectric module 30. By reversing the direction of current through thermoelectric module 30, the wearable conditioner 10 can then be used to heat the wearer instead of cooling the wearer. The present invention may optionally include a power switch between the power source and thermoelectric module 30 to specifically reverse the direction of current flow through thermoelectric module 30 so that the wearer may select between a cooling mode and a heating mode.

It should be understood by those skilled in the art that at least one power source (not shown) is connected to thermoelectric module 30 and to fan blower 70. Power is supplied from sources including, but not limited to, batteries, solar power, fuel cells, or other outside power source to power thermoelectric module 30 and fan blower 70.

It should also be noted that the portable/wearable air conditioner can be incorporated into other specially designed clothing, footwear, headwear, handwear, undergarments, accessories, bullet-proof apparel/body armor, etc. The structure of the air conditioner of the present invention can also be incorporated into other flexible material-based devices such as sleeping bags, tents, etc.

Figure 4:
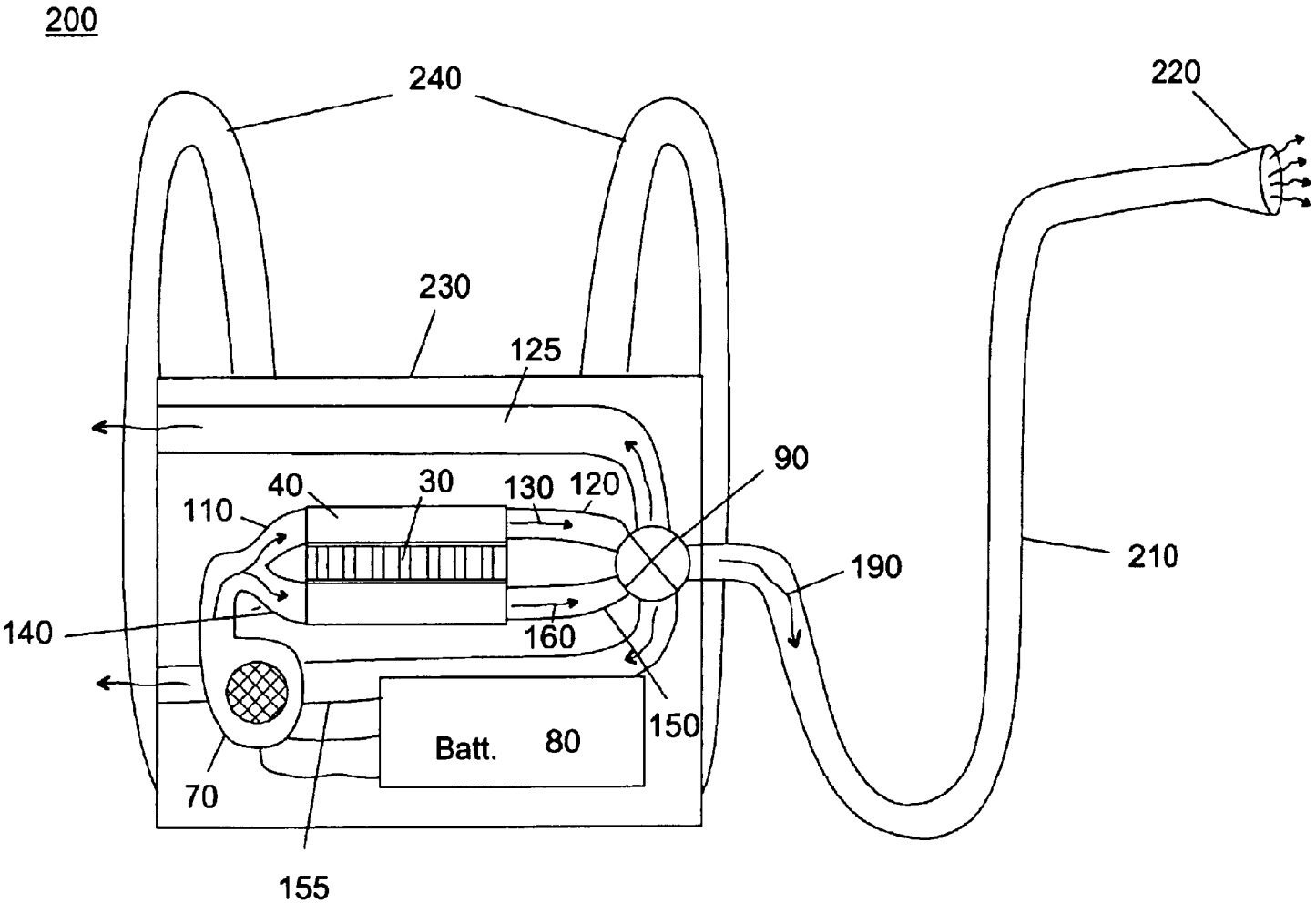
FIG. 4 is a plan view of an alternative embodiment of the present invention showing a portable, wearable air conditioner.

FIG. 4 is a plan view of an alternative embodiment of the present invention showing a portable and wearable air conditioner. The portable/wearable air conditioner 200 has at least one thermoelectric module 30, at least one fan blower 70 to generate air flow, at least one heat sink 40 to facilitate heat exchange between thermoelectric module 30 and the air flow provided by blower 70, module air inflow ducts 110, 140, a hose 210, an optional vented hose attachment 220 to spread and distribute an air stream 190 to the users body, at least one power source 80 deriving power from such sources as, for example, batteries, solar power, fuel cells, or other outside power sources to power thermoelectric module 30 and fan blower 70. The portable air conditioner also has a packaging enclosure 230 to integrate the components and a carry means 240 to allow the system to be easily carried or attached to the user. Carry means 240 may be shoulder straps, a waist belt, fastening clips or any of the well known devices used to facilitate carrying of the wearable air conditioner 200.

Wearable air conditioner 200 may optionally include a valve 90 between the module air outflow ducts 120 and 150 for selecting either the cooling mode of operation or the heating mode of operation. In the cooling mode (presuming that inflow duct 110 and outflow duct 120 are attached to the cooling side of thermoelectric module 30), the cool air stream 130 is delivered through valve 90 to hose 210 while the hot air stream 160 is passed through exhaust duct 155. In the heating mode, the hot air stream 160 is delivered through valve 90 to hose 210 while the cool air stream 130 is passed through exhaust duct 125.

Figure 5:
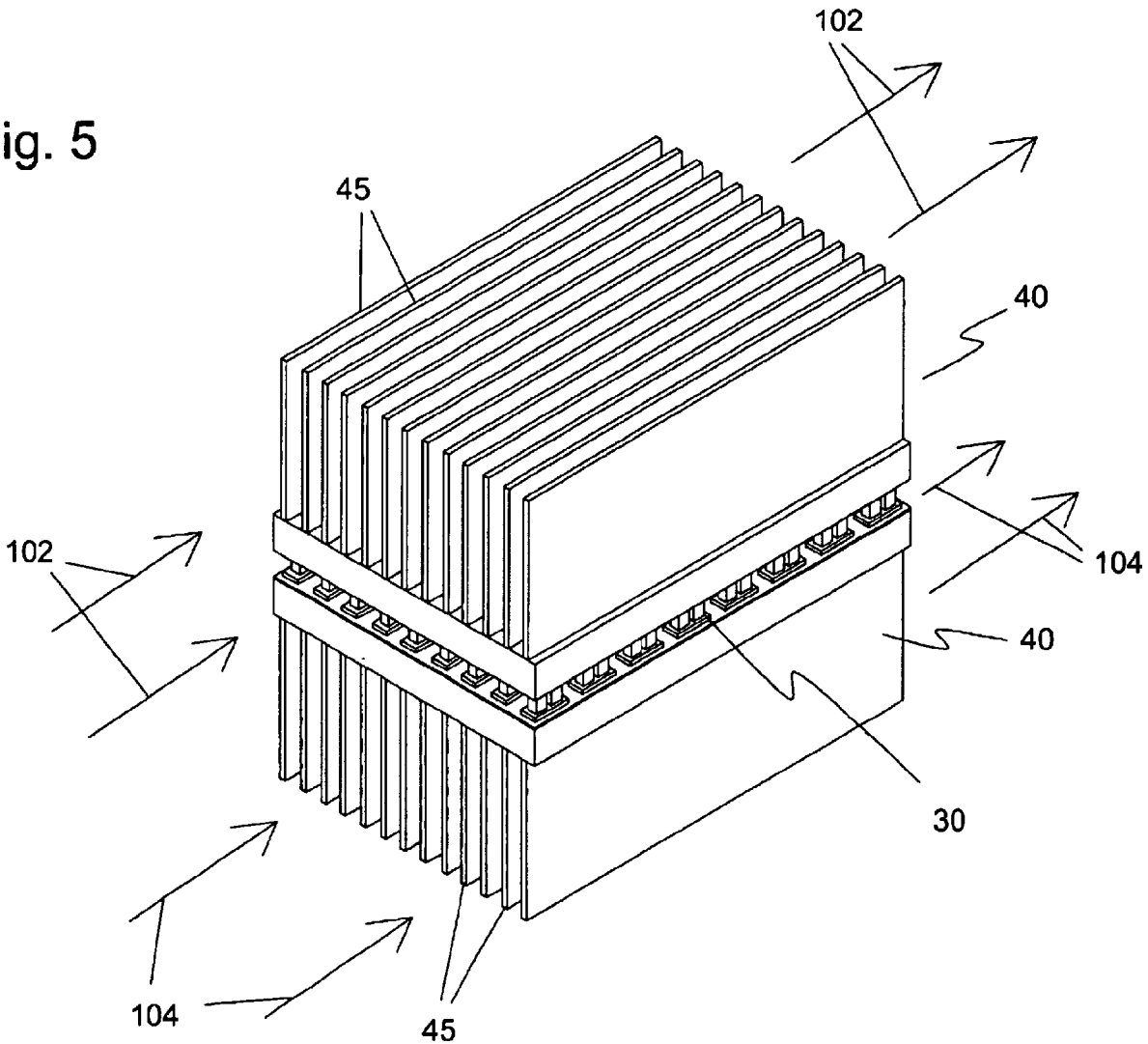
FIG. 5 is a perspective view of a thermoelectric module of the present invention.

An alternative to using valve 190 would involve directly connecting outflow duct 120 to hose 210 and directly exhausting outflow duct 150 to the atmosphere. This would create a wearable air conditioner 200 that is always in the cooling mode. Optionally, a power switch (not shown) that reverses the current to thermoelectric module 30 would also serve as a means for switching between a cooling and heating mode in a fixed duct-to-hose system. FIG. 5 is a perspective view of one embodiment of thermoelectric module 30 that may be incorporated within the present invention. The relative sizes of the components of thermoelectric module 30 are exaggerated for clarity. The heat exchangers 40 may be finned heat sinks where the plurality of fins 45 are parallel to air flow streams 102, 104 such that the air flow passes between fins 45.

Figure 6:
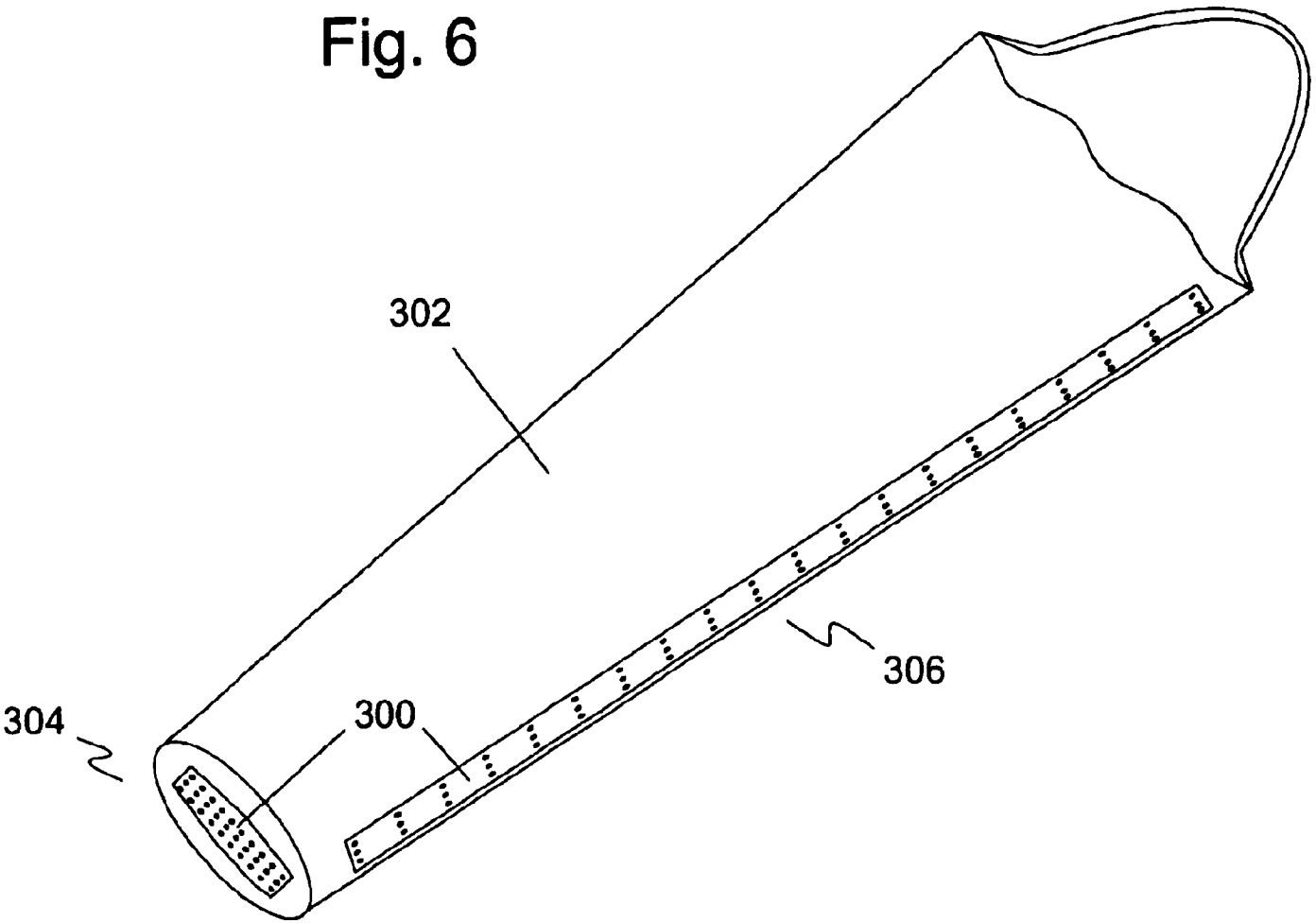
FIG. 6 is a perspective view of a thermoelectric module of the present invention incorporated into a sleeping bag.

Turning now to FIG. 6, there is illustrated the air conditioner of the present invention incorporated into another flexible material-based device. In this example, the present invention is incorporated into a sleeping bag. Air conditioner system 300 may be incorporated into any location in the flexible material of sleeping bag 302. Preferably, air conditioner system 300 is located within the flexible material where the user's body is less likely to interfere with the flow of air to the user that may arise through inadvertent blocking of the air flow through chambers 350 and 360 (not shown). For example, locating air conditioner system 300 at the foot 304 or along the side 306 of sleeping bag 302, or on the top is preferable.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. An air conditioner system to provide cooling or heating to a flexible material-based device, said system comprising:

a ventilated portion located within a flexible material body, said ventilated portion having a flexible material inner layer, a flexible material outer layer and an intermediate layer between said flexible material inner layer and said flexible material outer layer defining a first chamber and a second chamber, said flexible material inner layer and said flexible material outer layer having a plurality of vent openings;

at least one thermoelectric module with heat exchangers on opposite sides of said thermoelectric module wherein one of said heat exchangers is in communication with said first chamber and the other of said heat exchangers is in communication with said second chamber;

an air stream source incorporated within said flexible material body and positioned to deliver an air stream to said first chamber and said second chamber through said heat exchangers and out said plurality of vent openings; and a DC power source connected to said at least one thermoelectric module and said fan.

2. The system of claim 1 further comprising a power switch between said power source and said at least one thermoelectric element to reverse the direction of current flow through said at least one thermoelectric element.

3. The system of claim 1 wherein said DC power source is one or more of batteries, solar power, or fuel cells or any combination thereof.

4. The system of claim 3 wherein said flexible material body has one or more locations for holding said one or more batteries, solar power, or fuel cells.

5. A wearable air-conditioned garment to provide a cooling or heating to a wearer, said garment comprising:

a garment body;

a ventilated portion located within said garment body, said ventilated portion having a garment inner layer, a garment outer layer and an intermediate layer between said inner garment layer and said outer garment layer defining a first chamber and a second chamber, said garment inner layer and said garment outer layer having a plurality of vent openings;

at least one thermoelectric module with heat exchangers on opposite sides of said thermoelectric module wherein one of said heat exchangers is in communication with said first chamber and the other of said heat exchangers is in communication with said second chamber;

an air stream source incorporated within said garment and positioned to deliver an air stream to said first chamber and said second chamber through said heat exchangers and out said plurality of vent openings; and a DC power source connected to said at least one thermoelectric module and said fan.

6. The garment of claim 5 further comprising a power switch between said power source and said at least one thermoelectric element to reverse the direction of current flow through said at least one thermoelectric element.

7. The garment of claim 5 wherein said DC power source is one or more of batteries, solar power, or fuel cells or any combination thereof.

8. The garment of claim 7 wherein said garment body has one or more locations for holding said one or more batteries, solar power, or fuel cells.

9. A portable, wearable air conditioning unit comprising:

an enclosure adaptably configured to be wearable by a user;

a thermoelectric module positioned within said enclosure, said thermoelectric module configured with heat exchangers on opposite sides of said thermoelectric module wherein each of said heat exchangers is positioned within separated air streams;

an air flow source in fluid communication with said heat exchangers, said air flow source providing an air flow for said separated air streams;

a plurality of outlet air stream ducts wherein at least one of said plurality of outlet air stream ducts is configured to deliver one of said separated air streams to said user; and a DC power source connected to at least said thermoelectric module.

10. The wearable air conditioning unit of claim 9 wherein said enclosure is adaptably configured for incorporation into a garment.

11. The wearable air conditioning unit of claim 9 wherein said DC power source is one or more of batteries, solar power, or fuel cells or any combination thereof.

12. The wearable air conditioning unit of claim 9 wherein said unit has one or more of shoulder straps, waist belt or fastening clips or any combination thereof.

13. A method of providing a wearable air conditioning unit, said method comprising:

incorporating a ventilated portion into a garment body, said ventilated portion having a garment inner wall, a garment outer wall and an intermediate wall between said garment inner wall and said garment outer wall forming a first chamber and a second chamber, said garment inner wall and said garment outer wall having a plurality of vent openings;

positioning at least one thermoelectric module in said garment body, said at least one thermoelectric module having heat exchangers on opposite sides wherein said heat exchangers are positioned within separated air stream ducts wherein one of said separated air stream ducts communicates with said first chamber and the other of said separated air stream ducts communicates with said second chamber;

providing an air flow to said heat exchangers; and powering said thermoelectric module to create a cooling air flow and a heated air flow.

* * * * *